US010401067B2

(12) United States Patent
Song et al.

(10) Patent No.: US 10,401,067 B2
(45) Date of Patent: Sep. 3, 2019

(54) AIR CONDITIONER

(71) Applicant: LG ELECTRONICS INC., Seoul (KR)

(72) Inventors: Chiwoo Song, Seoul (KR); Pilhyun Yoon, Seoul (KR); Kakjoong Kim, Seoul (KR); Jaehwa Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 278 days.

(21) Appl. No.: 15/415,255

(22) Filed: Jan. 25, 2017

(65) Prior Publication Data

US 2017/0219264 A1 Aug. 3, 2017

(30) Foreign Application Priority Data

Jan. 28, 2016 (KR) ..... 10-2016-0010952

(51) Int. Cl.
*F25B 47/00* (2006.01)
*F25B 13/00* (2006.01)
(Continued)

(52) U.S. Cl.
CPC ..... *F25B 47/006* (2013.01); *F25B 13/00* (2013.01); *F25B 39/00* (2013.01); *F25B 41/04* (2013.01);
(Continued)

(58) Field of Classification Search
CPC ..... F25B 47/006; F25B 47/022; F25B 13/00; F25B 39/00; F25B 2700/2117
See application file for complete search history.

(56) References Cited

U.S. PATENT DOCUMENTS 4,625,524 A * 12/1986 Kimura ..... F25B 47/006 62/278
4,739,627 A * 4/1988 Baumann ..... A01G 9/246 62/263
(Continued)

FOREIGN PATENT DOCUMENTS

JP 2008-249236 A 10/2008
JP 2010-159926 A 7/2010
(Continued)

OTHER PUBLICATIONS

Morimoto, Freezer, Aug. 2014, JP2014149141A, Whole Document.*

*Primary Examiner* — Larry L Furdge
(74) *Attorney, Agent, or Firm* — Dentons US LLP

(57) ABSTRACT

An air conditioner including a hot gas line for receiving a portion of refrigerant compressed in a compressor, an indoor heat exchanger, an outdoor expansion device for expanding the refrigerant having exchanged heat in the indoor heat exchanger, an outdoor heat exchanger functioning as a condenser in a cooling mode while functioning as an evaporator in a heating mode, and a 4-way valve for receiving a remaining portion of the compressed refrigerant, to guide the refrigerant emerging from the compressor to the outdoor heat exchanger in the cooling mode and to the indoor heat exchanger in the heating mode. The outdoor heat exchanger includes a main heat exchanger section functioning as a condenser in the cooling mode while functioning as an evaporator in the heating mode, and an auxiliary heat exchanger for receiving the refrigerant from the hot gas line in a frosting prevention mode.

17 Claims, 6 Drawing Sheets

(51) Int. Cl.
*F25B 39/00* (2006.01)
*F25B 41/04* (2006.01)
*F25B 47/02* (2006.01)

(52) U.S. Cl.
CPC ..... *F25B 47/022* (2013.01); *F25B 2313/005* (2013.01); *F25B 2313/006* (2013.01); *F25B 2313/0251* (2013.01); *F25B 2313/0253* (2013.01); *F25B 2313/02522* (2013.01); *F25B 2313/02532* (2013.01); *F25B 2313/02533* (2013.01); *F25B 2313/02541* (2013.01); *F25B 2313/02741* (2013.01); *F25B 2313/0315* (2013.01); *F25B 2400/075* (2013.01); *F25B 2600/2501* (2013.01); *F25B 2700/2117* (2013.01)

(56) References Cited

U.S. PATENT DOCUMENTS

| | | | | |
|---|---|---|---|---|
| 5,099,655 | A | 3/1992 | Arno et al. | |
| 2004/0134205 | A1* | 7/2004 | Park | F25B 13/00 62/151 |
| 2011/0232308 | A1 | 9/2011 | Morimoto et al. | |
| 2013/0104576 | A1* | 5/2013 | Lee | F25B 13/00 62/80 |
| 2013/0139533 | A1 | 6/2013 | Jeon | |

FOREIGN PATENT DOCUMENTS

| | | | | |
|---|---|---|---|---|
| JP | 2014149141 | A | * | 5/2014 |
| KR | 10-2013-0032681 | A | | 4/2013 |

* cited by examiner

AIR CONDITIONER

CROSS-REFERENCE TO RELATED APPLICATION

This application claims the priority benefit of Korean Patent Application No. 10-2016-0010952, filed on Jan. 28, 2016, in the Korean Intellectual Property Office, the disclosure of which is incorporated herein by reference.

BACKGROUND OF THE INVENTION

1. Field of the Invention

An air conditioner, and more particularly, an air conditioner that is capable of continuously performing a heating operation without requiring a defrosting operation.

2. Description of the Related Art

Generally, an air conditioner is an apparatus for cooling or heating an indoor space, using a refrigeration cycle including a compressor, an outdoor heat exchanger, an expansion device, and an indoor heat exchanger. The air conditioner may include a cooler for cooling an indoor space and a heater for heating an indoor space. Alternatively, the air conditioner may be a cooling and heating air conditioner for cooling or heating an indoor space.

The cooling and heating type air conditioner may include a 4-way valve for changing a flow path of a refrigerant compressed by a compressor in accordance with cooling and heating operations. That is, in the cooling mode, the refrigerant compressed by the compressor is delivered to an outdoor heat exchanger after passing through the 4-way valve. In this case, the outdoor heat exchanger operates as a condenser. The refrigerant, which is condensed in the outdoor heat exchanger, is introduced into an indoor heat exchanger after being expanded by an expansion device. In this case, the indoor heat exchanger operates as an evaporator. The refrigerant, which is evaporated in the indoor heat exchanger, is introduced into the compressor after again passing through the 4-way valve.

Meanwhile, in a heating mode, the refrigerant compressed by the compressor is delivered to the indoor heat exchanger after passing through the 4-way valve. In this case, the indoor heat exchanger operates as a condenser. The refrigerant, which is condensed in the indoor heat exchanger, is introduced into the outdoor heat exchanger after being expanded by the expansion device. In this case, the outdoor heat exchanger operates as an evaporator. The refrigerant, which is evaporated in the outdoor heat exchanger, is introduced into the compressor after again passing through the 4-way valve.

In such an air conditioner, water is produced on the surface of the heat exchanger operating as an evaporator during operation of the air conditioner. That is, water is produced on the surface of the indoor heat exchanger in the cooling mode, whereas water is produced on the surface of the outdoor heat exchanger in the heating mode. When water produced on the surface of the outdoor heat exchanger in the heating mode is frozen, smooth flow and efficient heat exchange of outdoor air may not be achieved. As a result, heating performance may be degraded.

Accordingly, when the refrigeration cycle operates in a reverse cycle mode (e.g., cooling operation) during heating operation in order to remove frozen condensed water, high-temperature and high-pressure refrigerant passes through the outdoor heat exchanger and, as such, frozen water on the surface of the outdoor heat exchanger is thawed by heat of the refrigerant. However, when the defrosting operation is performed using the reverse refrigeration cycle, there may be a problem because the indoor space heating should be stopped.

To solve the above-mentioned problem, Korean Unexamined Patent Publication No. 10-2009-0000925 discloses an air conditioner in which an outdoor heat exchanger is divided into a plurality of heat exchanger sections such that one of the heat exchanger sections performs heating operation, to operate as an evaporator, and the other of the heat exchanger sections performs defrosting operation by receiving high-pressure refrigerant from a compressor. However, because refrigerant used to defrost one heat exchanger section is introduced into an outlet stage of the other heat exchanger section, the temperature and pressure of the heat exchanger section performing heating operation (evaporator) are increased. As a result, insufficient heat exchange may be carried out in the heat exchanger section performing heating operation and, as such, there may be a problem in that the efficiency of the air conditioner may be degraded.

In the case in which a plurality of heat exchanger sections are used, there may be a problem in that the efficiency of the heat exchanger may be degraded when defrosting operation is carried out after formation of frost.

SUMMARY OF THE INVENTION

In view of the foregoing, at least one object the present invention to provide an air conditioner that is capable of heating an indoor space without requiring a defrosting operation.

Additionally, the present invention seeks to provide an air conditioner that is capable of achieving efficient heating operation of an outdoor heat exchanger including a plurality of heat exchanger sections.

It is understood that the present invention is not limited to the above-described objects, and other objects of the present invention not yet described will be more clearly understood by those skilled in the art from the following detailed description.

Accordingly, an embodiment of the present invention provides for an air conditioner including a compressor for compressing refrigerant, a hot gas line for receiving a portion of the refrigerant compressed in the compressor, an indoor heat exchanger for allowing the refrigerant compressed in the compressor to exchange heat with indoor air while passing through the indoor heat exchanger, an outdoor expansion device for expanding the refrigerant having exchanged heat in the indoor heat exchanger, an outdoor heat exchanger functioning as a condenser in a cooling mode while functioning as an evaporator in a heating mode, the outdoor heat exchanger allowing refrigerant to exchange heat with outdoor air while passing through the outdoor heat exchanger, and a 4-way valve for receiving a remaining portion of the refrigerant compressed in the compressor, to guide the refrigerant emerging from the compressor to the outdoor heat exchanger in the cooling mode and to the indoor heat exchanger in the heating mode, wherein the outdoor heat exchanger includes a main heat exchanger section functioning as a condenser in the cooling mode while functioning as an evaporator in the heating mode, and an auxiliary heat exchanger for receiving the refrigerant emerging from the hot gas line in a frosting prevention mode, wherein the main heat exchanger section exchanges heat with outdoor air having exchanged heat with the auxiliary heat exchanger section while passing around the auxiliary heat exchanger section.

In accordance with another embodiment of the present invention, the outdoor heat exchanger may include a main heat exchanger section functioning as a condenser in the cooling mode while functioning as an evaporator in the heating mode, and an auxiliary heat exchanger for receiving the refrigerant emerging from the hot gas line in a frosting prevention mode, and the main heat exchanger section may exchange heat with outdoor air having exchanged heat with the auxiliary heat exchanger section while passing around the auxiliary heat exchanger section. The hot gas line may be connected to the auxiliary heat exchanger section. The air conditioner may further include a hot gas relief valve arranged at the hot gas line, to adjust a flow of refrigerant through opening or closing thereof.

The auxiliary heat exchanger section may function as a condenser in the cooling mode, may function as an evaporator in the heating mode, and may function as a condenser in the frosting prevention mode.

In the frosting prevention mode, the refrigerant emerging from the auxiliary heat exchanger section may flow to the main heat exchanger section, and may evaporate in the main heat exchanger section.

The air conditioner may further include a main distribution line for guiding refrigerant condensed in the indoor heat exchanger to the main heat exchanger section in the heating mode, and an auxiliary distribution line for guiding the refrigerant condensed in the indoor heat exchanger to the auxiliary heat exchanger section in the heating mode.

The outdoor expansion device may include a main expansion valve arranged at the main distribution line, to adjust an opening degree of the main distribution line, and an auxiliary expansion valve arranged at the auxiliary distribution line, to adjust an opening degree of the auxiliary distribution line.

The hot gas line may be branched between the 4-way valve and the compressor.

The hot gas line may be connected to the auxiliary distribution line.

The air conditioner may further include an auxiliary connecting line for guiding the refrigerant emerging from the auxiliary heat exchanger section to the main heat exchanger section in the frosting prevention mode.

The air conditioner may further include a main header pipe for guiding the refrigerant emerging from the main heat exchanger section to the compressor in the heating mode, an auxiliary header pipe connected to the main header pipe, to guide the refrigerant emerging from the auxiliary heat exchanger section to the compressor in the heating mode, and a header relief valve arranged at the auxiliary header pipe, to selectively allow flow of refrigerant through the auxiliary header pipe.

The air conditioner may further include a housing comprising a suction portion for suctioning outdoor air, and a discharge portion for discharging the suctioned air, the housing defining an air channel for guiding the suctioned outdoor air to pass therethrough. The main heat exchanger section may be arranged in the air channel of the housing.

The auxiliary heat exchanger section may be arranged between the main heat exchanger section and the suction portion.

The auxiliary heat exchanger section may close at least a part of the suction portion outside the suction portion.

The air conditioner may further include a fan for generating a flow of air in a direction from the suction portion to the discharge portion.

The main heat exchanger section may overlap the auxiliary heat exchanger section.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
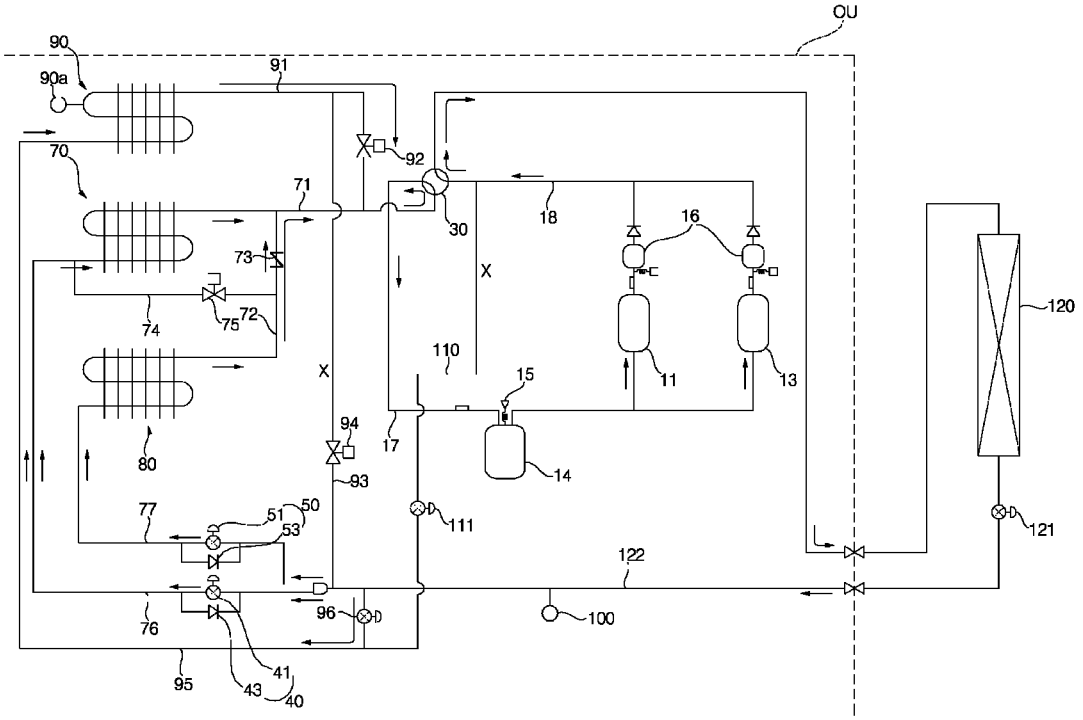
FIG. 1 is a diagram illustrating a refrigerant flow in an outdoor unit during heating operation of an air conditioner according to a first embodiment of the present invention.

Reference will now be made in detail to embodiments, examples of which are illustrated in the accompanying drawings. However, the present disclosure may be embodied in many different forms and should not be construed as limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. It will be further understood that the terms "comprises" and/or "comprising," when used in this specification, specify the presence of stated components, steps, and/or operations, but do not preclude the presence or addition of one or more other components, steps, and/or operations.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience in description and clarity. The size or area of each constituent element does not entirely reflect the actual size thereof.

Hereinafter, embodiments of the present invention will be described with reference to the accompanying drawings explaining air conditioners.

Figure 2:
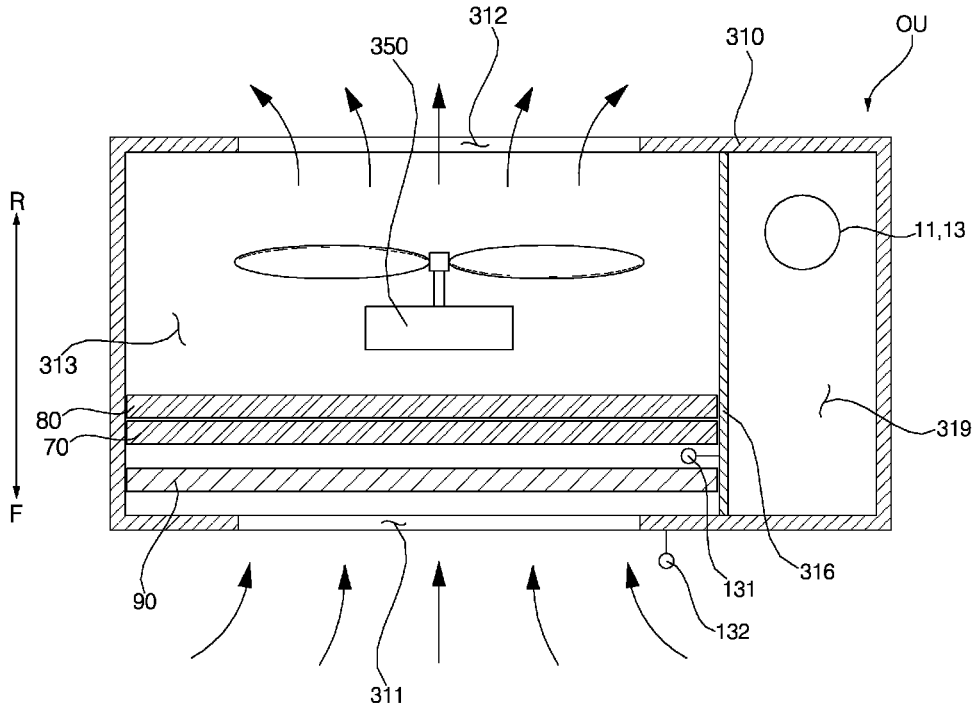
FIG. 2 is a sectional view of the outdoor unit shown in FIG. 1.

FIG. 1 is a diagram illustrating a refrigerant flow in an outdoor unit during heating operation of an air conditioner according to an embodiment of the present invention. FIG. 2 is a sectional view of the outdoor unit according to the illustrated embodiment of the present invention.

The overall configuration of the air conditioner according to the illustrated embodiment will be described with reference to FIG. 1.

Although not shown, the air conditioner may include a plurality of indoor units and a plurality of outdoor units OU. The plurality of indoor units and the plurality of outdoor units are connected by refrigerant lines. The plurality of indoor units are installed at a plurality of areas desired by the user to be cooled or heated.

Referring to FIG. 1, the air conditioner includes compressors 11 and 13, a hot gas line 110, a 4-way valve 30, an indoor heat exchanger 120, an outdoor expansion device, and an outdoor heat exchanger 70-80-90. The compressors 11 and 13, hot gas line 110, 4-way valve 30, indoor heat exchanger 120, outdoor expansion device and outdoor heat exchanger 70-80-90 of the air conditioner may be provided in an outdoor heat exchanger OU.

The compressors 11 and 13 compress refrigerant. For example, one of the compressors 11 and 13 may be constituted by a variable displacement compressor such as an inverter compressor, and the other of the compressors 11 and 13 may be constituted by a constant speed compressor. A gas-liquid separator 14 may be connected to inlet sides of the compressors 11 and 13. An oil separator 16 and a check valve may be provided at each outlet side of the compressors 11 and 13.

Each of the compressors 11 and 13 may compress refrigerant introduced into the inlet side thereof in a compression chamber thereof, and then discharge the compressed refrigerant through the outlet side thereof. As shown, a discharge line 18 may be connected to the outlet sides of the compressors 11 and 13, and an introduction line 17 may be connected to the inlet sides of the compressors 11 and 13. The discharge line 18 may be connected to the indoor heat exchanger 120 or the outdoor heat exchanges 70, 80 and 90 by the 4-way valve 30.

Refrigerant discharged from the outlet sides may flow to the 4-way valve 30 connected to the discharge line 18.

The 4-way valve 30 may change or affect the flow direction of refrigerant in accordance with cooling and heating modes of the air conditioner. For example, in a cooling mode, the 4-way valve 30 may guide refrigerant evaporated in the indoor heat exchanger 120 to the compressors 11 and 13 while guiding refrigerant compressed in the compressors 11 and 13 to the outdoor heat exchanger 70-80-90. In a heating mode, the 4-way valve 30 may guide refrigerant evaporated in the outdoor heat exchanger 70-80-90 to the compressors 11 and 13 while guiding refrigerant compressed in the compressors 11 and 13 to the indoor heat exchanger 120. In a frosting prevention mode, the 4-way valve 30 may guide refrigerant evaporated in the outdoor heat exchanger 70-80-90 to the compressors 11 and 13 while guiding, to the indoor heat exchanger 120, a portion of the refrigerant compressed in the compressors 11 and 13, namely, refrigerant not introduced into the hot gas line 110.

The 4-way valve 30 may be connected to the discharge line 18 of the compressors 11 and 13, the introduction line 17 of the compressors 11 and 13, the indoor heat exchanger 120, and the outdoor heat exchanger 70-80-90. For example, in the cooling mode, the 4-way valve 30 may connect the outlet sides of the compressors 11 and 13 to the outdoor heat exchanger 70-80-90, and connect the indoor heat exchanger 120 to the inlet sides of the compressors 11 and 13. In the heating mode, the 4-way valve 30 may connect the outlet sides of the compressors 11 and 13 to the indoor heat exchanger 120, and connect the outdoor heat exchanger 70-80-90 to the inlet sides of the compressors 11 and 13.

The indoor heat exchanger 120 cools or heats indoor air through heat exchange of the indoor air with refrigerant. For example, in the cooling mode, refrigerant may cool indoor air while being evaporated. In the heating mode, refrigerant compressed in the compressors 11 and 13 may heat indoor air while being condensed. In a defrosting mode, refrigerant emerging from the 4-way valve 30 may heat indoor air while flowing. Although not shown, the indoor heat exchanger 120 may include a plurality of heat exchangers to cool or heat a plurality of indoor spaces. The indoor heat exchanger 120 may be connected to the 4-way valve 30 and an indoor expansion valve 121.

In the cooling mode, an opening degree of the indoor expansion valve 121 may be adjusted, and refrigerant may be expanded through adjustment of opening degree. Alternatively, in the heating mode, the indoor expansion valve 121 may be fully opened to allow refrigerant to pass therethrough. The indoor expansion valve 121 may be provided between the indoor heat exchanger 120 and the outdoor heat exchanger 70-80-90.

In the cooling mode, the indoor expansion valve 121 may expand refrigerant fed to the indoor heat exchanger 120. In the heating mode, the indoor expansion valve 121 may guide or direct refrigerant introduced from the indoor heat exchanger 120 to the compressors 11 and 13.

The outdoor heat exchanger 70-80-90 may be installed in the outdoor unit, which is provided at an outdoor space. The outdoor heat exchanger 70-80-90 may perform heat exchange of refrigerant passing therethrough with outdoor air. The outdoor heat exchanger 70-80-90 may operate as a condenser for condensing refrigerant in the cooling mode, and operate as an evaporator for evaporating refrigerant in the heating mode.

The outdoor heat exchanger 70-80-90 may be connected to the 4-way valve 30 and the outdoor expansion device. In the cooling mode, refrigerant emerging from the 4-way valve 30 after being compressed in the compressors 11 and 13 may be introduced or delivered into the outdoor heat exchanger 70-80-90, and may then be fed or delivered to the outdoor expansion device after being condensed. In the heating mode, refrigerant expanded in the outdoor expansion device may be fed or delivered to the outdoor heat exchanger 70-80-90, and may then be fed or delivered to the 4-way valve 30 after being evaporated.

The outdoor expansion device may include main expansion valves 41 and 51, an auxiliary expansion valve 96, and check valves 43 and 53. The main expansion valve 41 and check valve 43 may constitute an outdoor expansion section 40, and the main expansion valve 51 and check valve 53 may constitute an outdoor expansion section 50. The outdoor expansion sections 40 and 50 may constitute the outdoor expansion device.

In the heating mode, refrigerant condensed in the indoor heat exchanger 120 may expand while passing through the main expansion valves 41 and 51 and the auxiliary expansion valve 96. In the cooling mode, refrigerant emerging from the outdoor heat exchanger 70-80-90 may pass the check valves 43 and 53, and may expand in the indoor expansion valve 121. Alternatively, in the cooling mode, refrigerant emerging from the outdoor heat exchanger 70-80-90 may pass through the valves 41, 51 and 96, which may be fully opened.

The gas-liquid separator 14 may receive refrigerant evaporated in the outdoor heat exchanger 70-80-90 or the indoor heat exchanger 120 via the 4-way valve 30. Accordingly, the gas-liquid separator 14 may be maintained at a temperature of about 0 to 5° C. and, as such, may discharge cold energy to outside. The surface temperature of the gas-liquid separator 14 is generally lower than the temperature of refrigerant condensed in the outdoor heat exchanger 70-80-90 in the cooling mode. The gas-liquid separator 14 may have a longitudinally elongated cylindrical shape, but is not limited thereto.

In the air conditioner of the illustrated embodiment, the outdoor heat exchanger 70-80-90 includes a plurality of heat exchanger sections to reduce heat exchange between refrigerant and air in the heating mode and to increase heat exchange between refrigerant and air in the cooling mode through change of a refrigerant path in the cooling and heating modes. Such configuration functions to maximize the efficiency of the air conditioner.

In addition, the air conditioner of the illustrated embodiment has a feature in that refrigerant emerging from the hot gas line 110 performs a frosting prevention function while flowing through one of the heat exchanger sections, expands while passing through the outdoor expansion device after frosting prevention, and then evaporates while passing through another one of the heat exchanger sections, to perform heating.

Hereinafter, change of the refrigerant path in the heating and cooling modes, lines capable of performing frosting prevention, and the configuration of the outdoor heat exchanger 70-80-90 are described.

The plurality of heat exchanger sections may include a main heat exchanger section, through which refrigerant flows partially or completely, and an auxiliary heat exchanger section 90. One or more main heat exchanger sections and one or more auxiliary heat exchanger sections may be provided and, as such, there is no limitation on the numbers of the main heat exchanger sections and auxiliary heat exchanger sections. In the illustrated embodiment, two main heat exchanger sections and one auxiliary heat exchanger section 90 are provided.

Each of the main heat exchanger sections and auxiliary heat exchanger section 90 is a device in which refrigerant flowing within the device exchanges heat with ambient air. Each heat exchanger section may include, for example, a plurality of refrigerant tubes, through which refrigerant flows, and a plurality of heat transfer fins, and, as such, refrigerant in the heat exchanger section exchanges heat with air.

The main heat exchanger sections may include a first heat exchanger section 70 and a second heat exchanger section 80. Each main heat exchanger section operates as a condenser in the cooling mode and operates as an evaporator in the heating mode. Refrigerant exchanges heat with ambient air while passing through each main heat exchanger section.

In the frosting prevention mode, refrigerant emerging from the hot gas line 110 may be introduced into the auxiliary heat exchanger section 90. The auxiliary heat exchanger section 90 operates as a condenser in the cooling mode and operates as an evaporator in the heating mode. The auxiliary heat exchanger section 90 operates as a condenser in the frosting prevention mode. In the frosting prevention mode, refrigerant emerging from the auxiliary heat exchanger section 90 may be introduced into the main heat exchangers and, as such, be evaporated in the main heat exchanger sections.

The auxiliary heat exchanger section 90 may thus prevent frosting by increasing the evaporation temperature of refrigerant therein. The auxiliary heat exchanger section 90 may also reduce the relative humidity of ambient air flowing around the main heat exchanger sections and, as such, prevent frosting of the main heat exchanger sections. Exemplary embodiments of the main heat exchanger sections and auxiliary heat exchanger section are described below.

In the heating mode, refrigerant introduced into the outdoor heat exchanger may be distributed by a main distribution line and an auxiliary distribution line 95.

In the heating mode, the main distribution line may guide or direct refrigerant condensed in the indoor heat exchanger 120 to the main heat exchanger sections. The main distribution line may include a first distribution line 76 and a second distribution line 77.

In the heating mode, the auxiliary distribution line 95 may guide or direct refrigerant condensed in the indoor heat exchanger 120 to the auxiliary heat exchanger section 90. The auxiliary distribution line 95 may be connected, at one end thereof, to the auxiliary heat exchanger section 90 while being connected, at the other end thereof, to the hot gas line 110. The auxiliary distribution line 95 may additionally be connected to an indoor unit line 122.

In the heat mode, the first distribution line 76 may guide or direct refrigerant condensed in the indoor heat exchanger 120 to the first heat exchanger section 70. The first distribution line 76 may be connected to the indoor heat exchanger 120 and the first heat exchanger section 70. The first distribution line 76 may also connected to the indoor unit line 122, an auxiliary connecting line 93 and the second distribution line 77.

In the heating mode, the second distribution line 77 may guide or direct refrigerant condensed in the indoor heat exchanger 120 to the second heat exchanger section 80. The second distribution line 77 may be connected to the first distribution line 76, the indoor heat exchanger 120 and the second heat exchanger section 80. The second distribution line 77 may also be connected to the indoor unit line 122, the auxiliary connecting line 93 and the first distribution line 76.

That is, for example, in the heating mode, the first distribution line 76 and second distribution line 77 may distribute refrigerant emerging from the indoor heat exchanger 120 to the first heat exchanger section 70 and second heat exchanger section 80, respectively.

In the heating mode, the auxiliary distribution line 95 may guide or direct refrigerant condensed in the indoor heat exchanger 120 to the auxiliary heat exchanger section 90. The auxiliary distribution line 95 may be connected to the second distribution line 77, the first distribution line 76, the indoor heat exchanger 120 and the auxiliary heat exchanger section 90. That is, for example, in the heating mode, the auxiliary distribution line 95 may distribute refrigerant emerging from the indoor heat exchanger 120 to the first and second heat exchanger sections 70 and 80 of the main heat exchanger sections and the auxiliary heat exchanger section 90.

In addition, the auxiliary distribution line 95 may be connected to the hot gas line 110. In the frosting prevention mode, accordingly, the auxiliary distribution line 95 may supply high-temperature and high-pressure refrigerant compressed in the compressors 11 and 13 to the auxiliary heat exchanger section 90.

The indoor unit line 122, which is further included in the air conditioner, may guide or direct refrigerant emerging from the indoor heat exchanger 120 in the heating mode. The main distribution line may be branched from the indoor unit line 122. The auxiliary distribution line 95 may be branched from the indoor unit line 122 between the main distribution line and the indoor heat exchanger 120.

The flow path of refrigerant passing through the first distribution line 76, the second distribution line 77 and the auxiliary distribution line 95 may be adjusted by the outdoor expansion device. The outdoor expansion device may include the main expansion valves arranged at the main distribution line, to adjust an opening degrees of the main distribution line, respectively, and the auxiliary expansion valve 96 arranged at the auxiliary distribution line 95, to adjust an opening degree of the auxiliary distribution lines 95.

The main expansion valves may include the first expansion valve 41, which is arranged at the first distribution line 76, to adjust an opening degree of the first distribution line 76, and the second expansion valve 51, which is arranged at the second distribution line 77, to adjust an opening degree of the second distribution line 77.

The first expansion valve 41 may be connected to the first heat exchanger section 70 and, as such, expand refrigerant introduced from the indoor heat exchanger 120 while allowing refrigerant introduced from the first heat exchanger section 70 to pass therethrough. The first check valve 43 may be arranged at the first distribution line 76, to allow flow of refrigerant from the first heat exchanger section 70 to the indoor heat exchanger 120 while preventing flow of refrigerant from the indoor heat exchanger 120 to the first heat exchanger section 70.

The second expansion valve 51 may be connected to the second heat exchanger section 80 and, as such, expand refrigerant introduced from the indoor heat exchanger 120 while allowing refrigerant introduced from the second heat exchanger section 80 to pass therethrough. The second check valve 53 may be arranged at the second distribution line 77, to allow flow of refrigerant from the second heat exchanger section 80 to the indoor heat exchanger 120 while preventing flow of refrigerant from the indoor heat exchanger 120 to the second heat exchanger section 80.

The auxiliary expansion valve 96 may be connected to the auxiliary heat exchanger section 90 and, as such, expand refrigerant introduced from the indoor heat exchanger 120 while allowing refrigerant introduced from the auxiliary heat exchanger section 90 to pass therethrough or preventing the refrigerant from passing therethrough.

Each of the first expansion valve 41, the second expansion valve 51 and the auxiliary expansion valve 96 may be constituted by an electronic expansion valve.

In the heating mode, refrigerant emerging from the main heat exchanger sections and auxiliary exchanger section 90 may be returned to the compressor 11 and 13 via a main header pipe and an auxiliary header pipe 91. In the cooling mode, refrigerant emerging from the compressors 11 and 13 may be introduced into the first heat exchanger section 70 and the second heat exchanger section 80 via the main header pipe.

In the heating mode, the main header pipe may guide or direct refrigerant emerging from the main heat exchanger sections to the compressors 11 and 13. The main header pipe may include a first header pipe 71 and a second header pipe 72.

In the heating mode, the first header pipe 71 may guide or direct refrigerant emerging from the first main heat exchanger section 70 to the compressors 11 and 13. In the cooling mode, the first header pipe 71 may guide or direct refrigerant emerging from the compressors 11 and 13 to the first heat exchanger section 70. The first header pipe 71 may be connected to the first heat exchanger section 70 and the compressors 11 and 13. The first header pipe 71 may also be connected to the second header pipe 72, the 4-way valve 30 and the auxiliary header pipe 91.

Accordingly, for example, in the heating mode, the first header pipe 71 may guide or direct refrigerant passing through the second header pipe 72 after emerging from the second heat exchanger section 80 to the compressors 11 and 13. In the heating mode, the first header pipe 71 may be connected to the inlet line 17 of the compressors 11 and 13. In the cooling mode, the first header pipe 71 may be connected to the outlet line 18 of the compressors 11 and 13. The first heat exchanger section 70 may be connected, at one side thereof, to the first distribution line 76 while being connected, at the other side thereof, to the first header pipe 71.

In the cooling mode, the second header pipe 72 may guide or direct refrigerant emerging from the first heat exchanger section 70 to the second heat exchanger section 80. In the heating mode, the second header pipe 72 may guide or direct refrigerant emerging from the second heat exchanger section 80 to the compressors 11 and 13. The second header pipe 72 may be connected to the second heat exchanger section 80 and the compressors 11 and 13. The second header pipe 72 may also be connected to the 4-way valve 30 and the first header pipe 71. Accordingly, in the heating mode, refrigerant emerging from the second header pipe 72 may be introduced into the first header pipe 71 and, as such, be returned to the compressors 11 and 13.

In the heating mode, the auxiliary header pipe 91 may guide or direct refrigerant emerging from the auxiliary heat exchanger section 90 to the compressors 11 and 13. The auxiliary header pipe 91 may be connected to the auxiliary heat exchanger section 90 and the compressors 11 and 13. The auxiliary header pipe 91 may also be connected to the 4-way valve 30 and the first header pipe 71. Accordingly, in the heating mode, refrigerant emerging from the auxiliary header pipe 91 may be introduced into the first header pipe 71 and, as such, be returned to the compressors 11 and 13.

A header relief valve 92 may be arranged at the auxiliary header pipe 91, to selectively allow flow of refrigerant through the auxiliary header pipe 91. In detail, the header relief valve 92 may be open in the heating mode and, as such, refrigerant emerging from the auxiliary heat exchanger section 90 may be introduced to the compressors 11 and 13. In the cooling mode, the header relief valve 92 may be closed and, as such, refrigerant emerging from the compressors 11 and 13 is prevented from being supplied to the auxiliary heat exchanger section 90. Accordingly, the efficiency of the outdoor heat exchanger in the cooling mode is enhanced. In the frosting prevention mode, the header relief valve 92 may be closed and, as such, refrigerant emerging from the auxiliary heat exchanger section 90 may be guided to the main heat exchanger sections.

In addition, in the illustrated embodiment, the air conditioner further includes a bypass line 74, a first relief valve 75 and a header check valve 73 to allow refrigerant to pass through the main heat exchanger sections in series in the cooling mode and to pass through the main heat exchanger sections in parallel in the heating mode.

The bypass line 74 may be connected to the first distribution line 76 and, as such, guide refrigerant to the second header pipe 72. The bypass line 74 may guide or direct refrigerant emerging from the first heat exchanger section 70 to the second header pipe 72. The bypass line 74 is branched between the first distribution line 76 and the first expansion valve 41, and is connected to the second header pipe 72.

The first relief valve 75 may be arranged at the first bypass line 74, to adjust flow of refrigerant through opening or closing thereof. When the first relief valve 75 is opened, refrigerant may flow from the first distribution line 76 to the second header pipe 72. When the first relief valve 75 is closed, flow of refrigerant from the second header pipe 72 to the first distribution line 76 is prevented. The first relief valve 75 may be opened in the cooling mode and may be closed in the heating mode and the defrosting mode.

In the cooling mode, the header check valve 73 may prevent introduction of refrigerant from the first header pipe 71 to the second header pipe 72. In the heating mode, the header check valve 73 may allow the introduction of refrigerant from the second header pipe 72 to the first header pipe 71.

The header check valve 73 may be arranged at the second header pipe 72. In detail, the header check valve 73 may be positioned between a point where the bypass line 74 is connected to the second header pipe 72 and a point where the first header pipe 71 is connected to the second header pipe 72.

A portion of refrigerant compressed in the compressors 11 and 13 may flow through the hot gas line 110. In detail, in the frosting prevention mode, a portion of high-temperature and high-pressure compressed in the compressors 11 and 13 may pass through the hot gas line 110 and, as such, be introduced into the heat exchanger sections of the outdoor heat exchanger 70-80-90, thereby defrosting the heat exchanger sections.

In the frosting prevention mode, the hot gas line 110 may guide or direct high-temperature and high-pressure refrigerant emerging from the compressors 11 and 13 to the auxiliary heat exchanger section 90. The hot gas line 110 may be connected to the auxiliary heat exchanger section 90. In detail, the hot gas line 110 may be connected to the auxiliary distribution pipe 95. The hot gas line 110 may be branched between the indoor heat exchanger 120 and the 4-way valve 30, to be connected to the first header pipe 71. In the illustrated embodiment, however, the hot gas line 110 is branched between the outlet sides of the compressors 11 and 13 and the 4-way valve 30, to be connected to the first header pipe 71. That is, the hot gas line 110 is connected, at one side thereof, to the auxiliary distribution line 95 while being connected, at the other side thereof, to the discharge line 18 of the compressors 11 and 13. With such configuration, it is possible to reduce pressure loss of refrigerant, as compared to the configuration in which refrigerant compressed in the compressors 11 and 13 is guided to the hot gas line 110 after passing through the 4-way valve 30.

In more detail, the hot gas line 110 may be connected, at one side thereof, to the auxiliary distribution line 95 between the auxiliary expansion valve 96 and the auxiliary heat exchanger section 90. Accordingly, in the frosting prevention mode, the auxiliary expansion valve 96 is closed and, as such, prevents high-temperature and high-pressure refrigerant compressed in the compressors 11 and 13 from flowing to the main heat exchanger sections.

A hot gas relief valve 111 may be arranged at the hot gas line 110, to adjust flow of refrigerant through opening or closing thereof. The hot gas relief valve 111 may be opened or closed to selectively allow flow of refrigerant through the hot gas line 110. In detail, in the frosting prevention mode, the hot gas relief valve 111 may be opened and, as such, guide or direct refrigerant compressed in the compressors 11 and 13 to the auxiliary heat exchanger section 90. In the heating mode and the cooling mode, the hot gas relief valve 111 is closed. The hot gas relief valve 111 may include a solenoid valve or an electronic expansion valve.

In the illustrated embodiment, the air conditioner further includes the auxiliary connecting pipe 93, which guides or directs refrigerant emerging from the auxiliary heat exchanger section 90 to the main heat exchanger sections in the frosting prevention mode. Refrigerant emerging from the auxiliary connecting pipe 93 is expanded in the main expansion valves, and is then delivered to the main heat exchanger sections.

In detail, the auxiliary connecting pipe 93 may be connected to the auxiliary header pipe 91 and the indoor unit line 122.

An auxiliary relief valve 94 may be arranged at the auxiliary connecting pipe 93, to adjust flow of refrigerant through opening or closing thereof. The auxiliary relief valve 94 may be opened or closed to selectively allow flow of refrigerant through the auxiliary connecting pipe 93. In detail, in the frosting prevention mode, the auxiliary relief valve 94 may be opened and, as such, guide or direct refrigerant emerging from the auxiliary heat exchanger section 90 to the main heat exchanger sections. In the heating mode and the cooling mode, the auxiliary relief valve 94 may be closed. The auxiliary relief valve 94 may include a solenoid valve or an electronic expansion valve.

Accordingly, in the illustrated embodiment, a part of the plural heat exchanger sections may perform a frosting prevention operation, and the remaining part of the plural heat exchanger sections may perform a heating operation and. As such, it is possible to continuously supply hot air to indoor spaces while performing a frosting prevention operation.

Meanwhile, an auxiliary heat exchanger section temperature sensor **90*a* may be installed at the auxiliary heat exchanger section 90, to measure the temperature of ambient air around the auxiliary heat exchanger section 90. An additional temperature sensor 100 may be provided at the outdoor heat exchanger 70-80-90, to measure the temperature of refrigerant introduced into the outdoor heat exchanger 70-80-90 or the temperature of outdoor air. To determine whether defrosting is required, the temperature of ambient air having passed around the outdoor heat exchanger 70-80-90** may be measured.

The outdoor heat exchanger 70-80-90 may include a fan 350 for blowing outdoor air to the outdoor heat exchanger 70-80-90.

In the illustrated embodiment, the pressure of refrigerant at the inlet sides of the compressors 11 and 13 may be measured, to determine whether a frosting prevention operation should be performed. To this end, in the illustrated embodiment, a pressure sensor 15 is installed at the gas-liquid separator 14, to measure the pressure of refrigerant at the inlet sides of the compressors 11 and 13. The pressure sensor 15 may be installed between the gas-liquid separator 14 and the compressors 11 and 13.

Hereinafter, the arrangements of the auxiliary heat exchanger section 90 and main heat exchanger sections are described with reference to FIG. 2.

The outdoor unit may include the main heat exchanger sections, auxiliary heat exchanger section 90, fan 350, and compressors 11 and 13. The outdoor unit may further include a housing 310 including a suction portion 311 for suctioning outdoor air and a discharge portion 312 for discharging the suctioned air while defining an air channel 313, through which the suctioned outdoor air passes.

The housing 310 includes a space for accommodating constituent elements therein. For example, the housing may have a hollow hexahedral shape. The suction portion 311 may be formed at a front wall of the housing 310, to suction air. The discharge portion 312 may be formed at a rear wall of the housing 310, to discharge air. The suction portion 311 may also be formed at a side wall of the housing 310 adjacent to the front wall of the housing 310. It is understood that the present invention is not limited to the above-described arrangement. The housing 310 may have various shapes to define the air channel 313 therein. The suction portion 311 forms an inlet of the air channel 313, and the discharge portion 312 forms an outlet of the air channel 313.

The inner space of the housing 310 may be include a partition wall 316 that separates the air channel 313 where the plural heat exchanger sections and the fan 350 are installed, and a machinery chamber 319 where the compressors 11 and 13 are installed.

Although the air channel 313 and the machinery chamber 319 have been described as being separated from each other by the partition wall 316 in the illustrated embodiment, the air channel 313 and the machinery chamber 319 may not be separated, if necessary.

The fan 350 may be installed in the air channel 313. The fan 350 generates flow of air in a direction from the suction portion 311 to the discharge portion 312. The fan 350 may be implemented using an axial fan.

The main heat exchanger sections may be arranged to face the suction portion 311 of the housing 310. The main heat exchanger sections may be arranged in the air channel 313. The main heat exchanger sections operate to exchange heat with outdoor air flowing through the air channel 313.

The main heat exchanger sections may be arranged to exchange heat with outdoor air having exchanged heat with the auxiliary heat exchanger section 90 while passing around the auxiliary heat exchanger section 90.

In detail, the auxiliary heat exchanger section 90 may be arranged between the main heat exchanger sections and the suction portion 311. That is, as shown, the auxiliary heat exchanger section 90 may be arranged forward (F) of the main heat exchanger sections. In detail, the auxiliary heat exchanger section 90, the first heat exchanger section 70, and the second heat exchanger section 80 may be arranged in this order. In FIG. 2, the bottom side, through which air is introduced, is defined as the front side F, and the side opposite to the front side F is defined as the rear side R.

The auxiliary heat exchanger section 90 may be arranged in the air channel 313. In detail, the auxiliary heat exchanger section 90 may have an area capable of closing the air channel 313 when viewed in a cross-section perpendicular to an axial direction of the fan 350. In addition, the auxiliary heat exchanger section 90 may have an area at least corresponding to the suction portion 311. The auxiliary heat exchanger section 90 may be arranged such that at least a portion thereof overlaps the main heat exchanger sections when viewed in the cross-section perpendicular to the axial direction of the fan 350. The auxiliary heat exchanger section 90 may be arranged such that overall portion of the auxiliary heat exchanger section 90 overlap the main heat exchanger sections when viewed in the cross-section perpendicular to the axial direction of the fan 350, and the center portion of the auxiliary heat exchanger section 90 is aligned with the center portions of the main heat exchanger sections.

Accordingly, when outdoor air is introduced through the suction portion 311, the introduced outdoor air may exchange heat with the main heat exchanger sections after exchanging heat with the auxiliary heat exchanger section 90. In the frosting prevention mode, the auxiliary heat exchanger section 90 may increase the temperature of air suctioned into the suction portion 311, thereby increasing the evaporation temperatures of the main heat exchanger sections. As such, frosting of the main heat exchanger sections may be prevented. In addition, since high-temperature and high-pressure refrigerant flows through the auxiliary heat exchanger section 90, frosting of the auxiliary heat exchanger section 90 may be prevented without using an additional configuration, such as a heater.

As a result, moisture included in air suctioned from outside is removed by the auxiliary heat exchanger section 90 and, as such, the suctioned air becomes beyond frosting conditions, thereby preventing frosting of the main heat exchanger sections. In addition, desired heat exchange efficiencies of the main heat exchanger sections may be secured. Of course, frosting of the auxiliary heat exchanger section 90 may also be prevented.

In the illustrated embodiment, the air conditioner may further include a dew point temperature sensor 132 for measuring the dew point temperature of outdoor air, and a main heat exchanger section temperature sensor 131 for measuring ambient temperature around the main heat exchanger sections.

The dew point temperature sensor 132 measures the dew point temperature of outdoor air, and output a value representing the measured dew point temperature to a controller 200 (described below). The dew point temperature sensor 132 may be installed outside the outdoor unit. In detail, the dew point temperature sensor 132 may be installed at the housing 310 in the vicinity of the suction portion 311.

The main heat exchanger section temperature sensor 131 measures the temperature of air around the main heat exchanger sections within the air channel 313. That is, the main heat exchanger section temperature sensor 131 may measure the temperature of air having exchanged heat with the auxiliary heat exchanger section 90 within the air channel 313. The main heat exchanger section temperature sensor 131 may be installed in the air channel 313. In detail, the main heat exchanger section temperature sensor 131 may be arranged between the auxiliary heat exchanger section 90 and the main heat exchanger sections.

Figure 5:
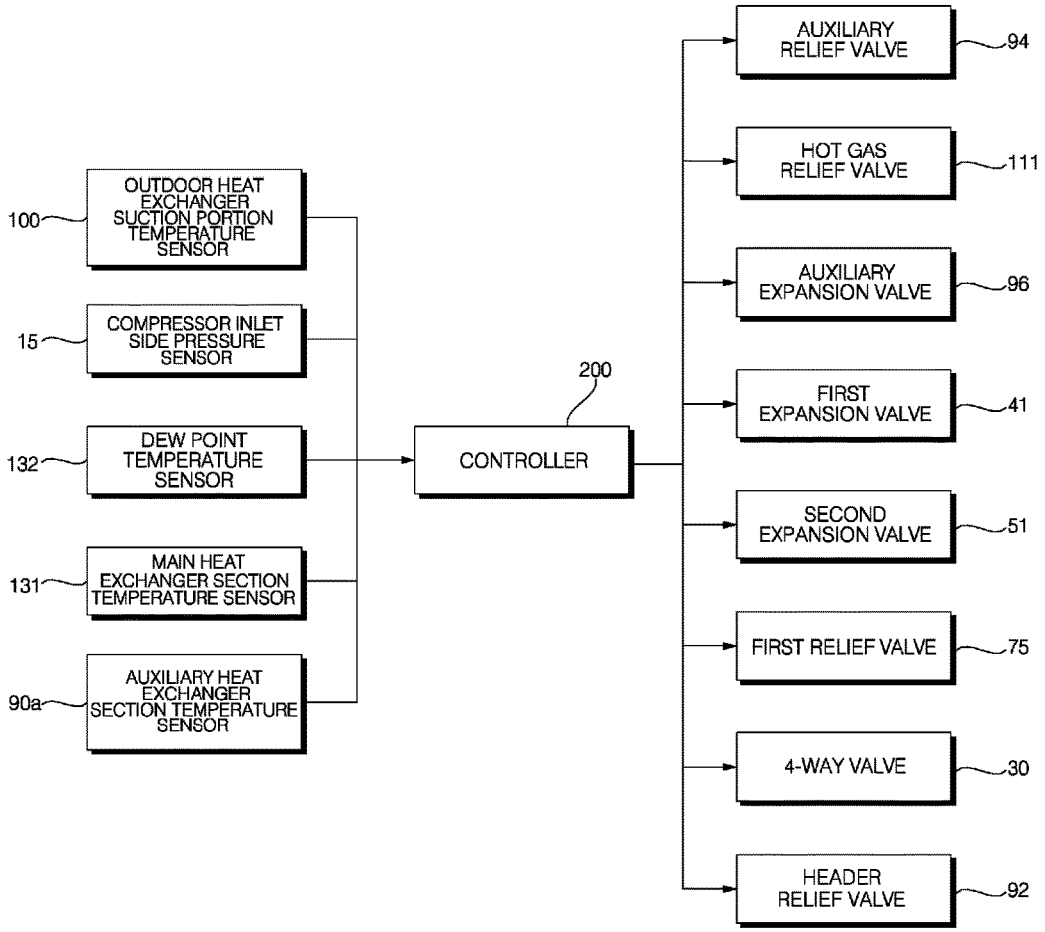
FIG. 5 is a block diagram illustrating control operation of the air conditioner according the first embodiment of the present invention.

FIG. 5 is a block diagram illustrating control operation of the air conditioner according the illustrated embodiment of the present invention.

Referring to FIGS. 1 and 5, the air conditioner may further include controller 200. The controller 200 may be implemented using a microprocessor capable of achieving logic determination.

The controller 200 may perform a comparison of temperature values measured by the dew point temperature sensor 132, auxiliary heat exchanger section temperature sensor **90*a*, and main heat exchanger section temperature sensor 131** in accordance with a frosting prevention operating method carried out in the air conditioner of the above-described embodiment.

For example, when the controller 200 determines that a frosting prevention operation is required in the outdoor heat exchanger 70-80-90, in accordance with the comparison of the measured temperature values, the controller 200 performs a control operation for opening/closing or switching the hot gas relief valve 111, the auxiliary expansion valve 96, the first expansion valve 41, the second expansion valve 51, the header relief valve 92, the auxiliary relief valve 94, and the 4-way valve 30 in accordance with the frosting prevention operating method in the air conditioner of the above-described embodiment.

In the illustrated embodiment, accordingly, the auxiliary heat exchanger section 90 performs a frosting prevention operation, and the main heat exchanger sections perform a heating operation.

The controller 200 may control the hot gas relief valve 111, based on the dew point temperature and the temperature of the auxiliary heat exchanger section 90 measured by the dew point temperature sensor 132 and the auxiliary heat exchanger section temperature sensor 90*a*.

For example, in the heating mode, the controller 200 may control the temperature of the auxiliary heat exchanger section 90 to be higher than the dew point temperature. Specifically, when the temperature of the auxiliary heat exchanger section 90 is higher than the dew point temperature in the heating mode, the controller 200 may close the hot gas relief valve 111. When the temperature of the auxiliary heat exchanger section 90 is less than or equal to the dew point temperature in the heating mode, the controller 200 may open the hot gas relief valve 111. When the temperature of the auxiliary heat exchanger section 90 is higher than the dew point temperature in the heating mode, the controller 200 may control the auxiliary expansion valve 96 to expand refrigerant. When the temperature of the auxiliary heat exchanger section 90 is less than or equal to the dew point temperature in the heating mode, the controller 200 may close the auxiliary expansion valve 96. When the temperature of the auxiliary heat exchanger section 90 is higher than the dew point temperature in the heating mode, the controller 200 may close the auxiliary relief valve 94. When the temperature of the auxiliary heat exchanger section 90 is less than or equal to the dew point temperature in the heating mode, the controller 200 may open the auxiliary relief valve 94.

In another example, in the heating mode, the controller 200 may control a first temperature measured by the main heat exchanger section temperature sensor 131 to be higher than the dew point temperature. Specifically, when the first temperature is higher than the dew point temperature in the heating mode, the controller 200 may close the hot gas relief valve 111. When the first temperature is less than or equal to the dew point temperature in the heating mode, the controller 200 may open the hot gas relief valve 111.

Hereinafter, flow of refrigerant will be described in conjunction with different operation modes of the air conditioner configured as described above in accordance with the illustrated embodiment of the present invention.

Flow of refrigerant in the heating mode of the air conditioner according to the illustrated embodiment will be described with reference to FIG. 1.

In the heating mode, refrigerant is compressed in the compressors 11 and 13. The refrigerant compressed in the compressors 11 and 13 may flow to the 4-way valve 30 via the discharge line 10. In this case, the header relief valve 92 is opened. Accordingly, refrigerant emerging from the auxiliary heat exchanger section 90 may be guided or directed to the first header pipe 71. The hot gas relief valve 111 is in a closed state and, as such, the refrigerant compressed in the compressors 11 and 13 may be prevented from entering the auxiliary heat exchanger section 90. The 4-way valve 30 may guide or direct refrigerant evaporated in the outdoor heat exchanger 70-80-90 to the compressors 11 and 13, and guide or direct the refrigerant compressed in the compressors 11 and 13 to the indoor heat exchanger 120.

Refrigerant emerging from the indoor heat exchanger 120 may pass through the indoor expansion valve 121, and pass through the first expansion valve 41, the second expansion valve 51, and the auxiliary expansion valve 96. Thus, the refrigerant expands.

The refrigerant emerging from the first expansion valve 41 may be introduced into the first heat exchanger section 70, and evaporated while exchanging heat with outdoor air blown by the fan 350. The refrigerant emerging from the second expansion valve 51 may be introduced into the second heat exchanger section 80, and evaporated while exchanging heat with outdoor air blown by the fan 350. The refrigerant emerging from the auxiliary expansion valve 96 may be introduced into the auxiliary heat exchanger section 90, and evaporated while exchanging heat with outdoor air blown by the fan 350.

The refrigerant emerging from the first heat exchanger section 70 may flow to the first header pipe 71. The refrigerant emerging from the second heat exchanger section 80 may flow to the second header pipe 72. The refrigerant emerging from the auxiliary heat exchanger section 90 may flow to the first header pipe 71 via the auxiliary header pipe 91. The refrigerant passing through the first heat exchanger section 70, the second heat exchanger section 80, and the auxiliary heat exchanger section 90 may again be introduced into the compressors 11 and 13.

Figure 3:
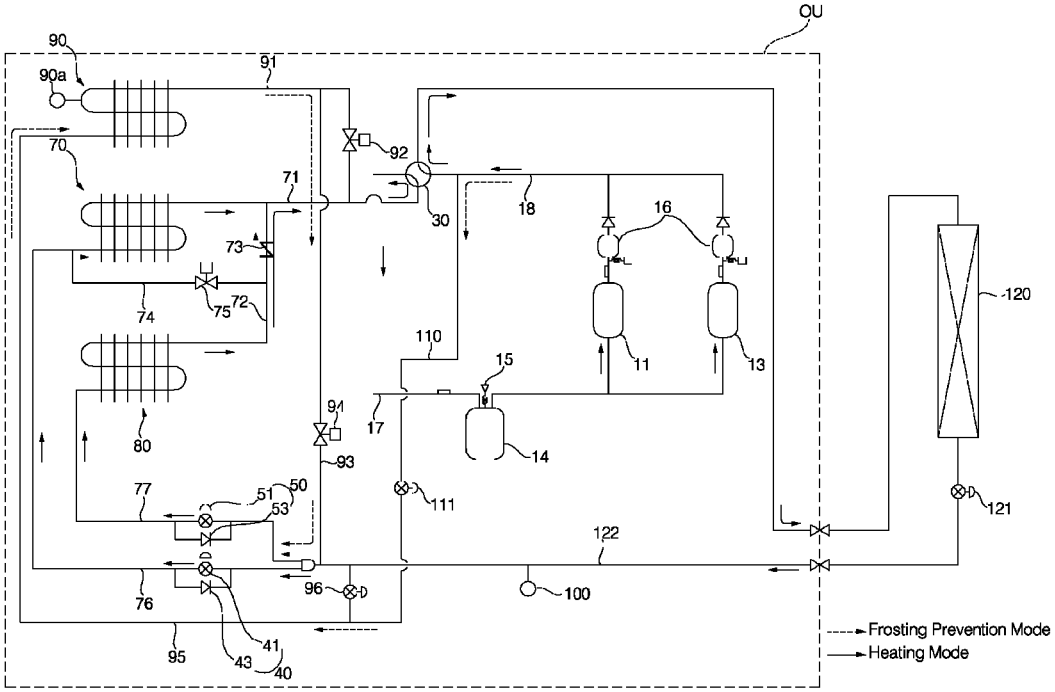
FIG. 3 is a diagram illustrating flow of refrigerant in a frosting prevention mode of the air conditioner according to the first embodiment of the present invention.

FIG. 3 is a diagram illustrating flow of refrigerant in the frosting prevention mode of the air conditioner according to the illustrated embodiment.

Hereinafter, flow of refrigerant in the frosting prevention mode of the air conditioner according to the illustrated embodiment will be described with reference to FIG. 3.

In the air conditioner of the illustrated embodiment, the main heat exchanger sections perform a heating operation when the auxiliary heat exchanger section 90 performs a frosting prevention operation. Accordingly, refrigerant compressed in the compressors 11 and 13 may flow to the 4-way valve 30 and the hot gas line 110. The hot gas relief valve 11 may be in an opened state and, as such, guide or direct refrigerant emerging from the hot gas line 110 to the auxiliary heat exchanger section 90.

The auxiliary expansion valve 96 may be in a closed state and, as such, prevent high-temperature and high-pressure refrigerant supplied through the hot gas line 110 from flowing to the main heat exchanger sections. The first and second expansion valves 41 and 51 expand refrigerant condensed in the indoor heat exchanger 120.

Refrigerant exchanging heat with the auxiliary heat exchanger section 90 after passing through the hot gas line 110 may be condensed in the auxiliary heat exchanger section 90, thereby preventing frosting of the auxiliary heat exchanger section 90 while heating outdoor air supplied to the main heat exchanger sections. The refrigerant emerging from the auxiliary heat exchanger section 90 may flow to the auxiliary connecting line 93.

In this case, for example, the header relief valve 92 is closed, and the auxiliary relief valve 94 is opened. The refrigerant flowing to the auxiliary connecting line 93 may be fed to the first distribution line 76 and the second distribution line 77, expand in the first expansion valve 41 and the second expansion valve 51, and then flow to the main heat exchanger sections. The refrigerant emerging from the main heat exchanger sections may pass through the first header pipe 71, and then return to the compressors 11 and 13.

The first relief valve 75 of the bypass line 74 may be in a closed state.

Figure 4:
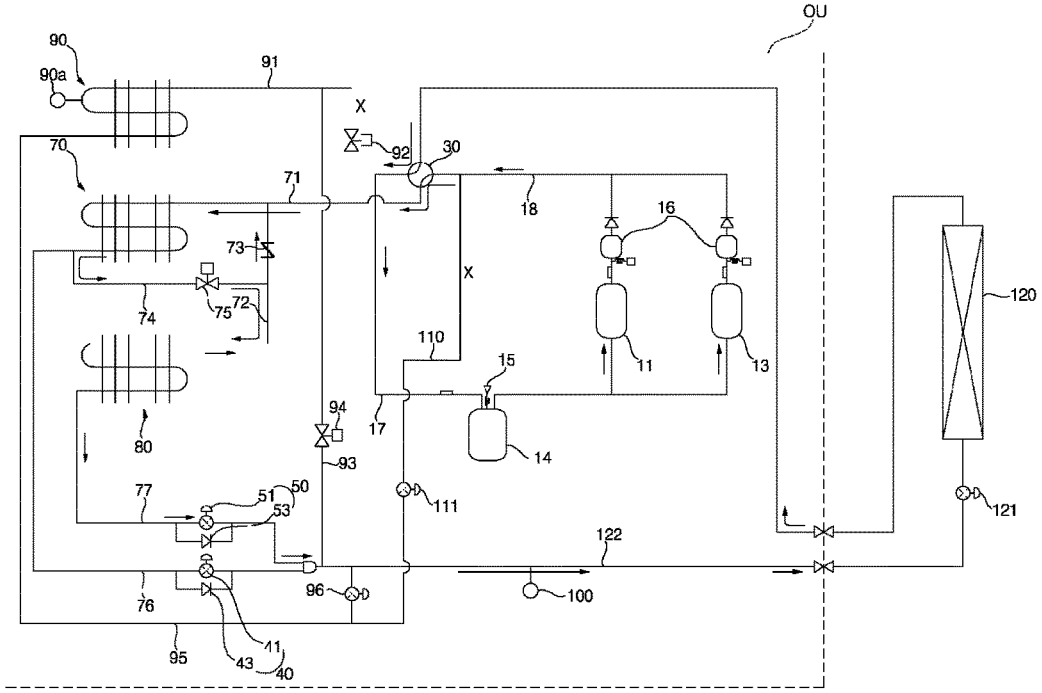
FIG. 4 is a diagram illustrating flow of refrigerant in a cooling mode of the air conditioner according to the first embodiment of the present invention.

FIG. 4 is a diagram illustrating flow of refrigerant in the cooling mode of the air conditioner according to the illustrated embodiment. Hereinafter, flow of refrigerant in the cooling mode of the air conditioner according to the illustrated embodiment will be described with reference to FIG. 4.

In the cooling mode, refrigerant is compressed in the compressors 11 and 13, and may then be guided to the 4-way valve 30. In this case, the hot gas relief valve 111 may prevent the refrigerant compressed in the compressors 11 and 13 from entering the auxiliary heat exchanger section 90.

The refrigerant compressed in the compressors 11 and 13 may completely flow to the 4-way valve 30. The refrigerant emerging from the 4-way valve 30 may be introduced into the first heat exchanger section 70 and the second heat exchanger section 80 and, as such, be condensed while exchanging heat with outdoor air blown by the fan 350.

In this case, the first relief valve 75 arranged at the bypass line 74 may be opened, and the header relief valve 92 and the auxiliary expansion valve 94 may be closed.

The refrigerant emerging from the first and second heat exchanger sections 70 and 80 may expand in the indoor expansion valve 121. The refrigerant evaporates while passing through the indoor heat exchanger 120. In this case, indoor air increased in temperature through heat exchange thereof with refrigerant while passing around the indoor heat exchanger 120 may heat an indoor space. The refrigerant emerging from the indoor heat exchanger 120 may pass through the 4-way valve 30 and the gas-liquid separator 14, and then again be introduced into the compressors 11 and 13.

Figure 6:
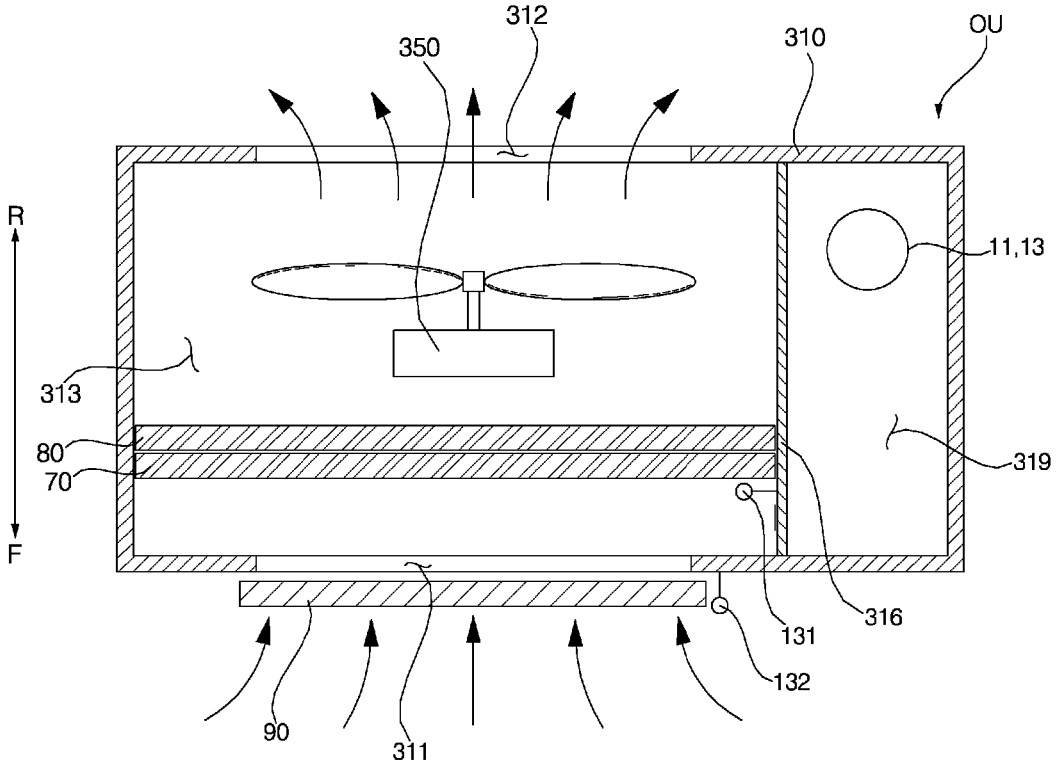
FIG. 6 is a sectional view of an outdoor unit according to a second embodiment of the present invention.

FIG. 6 is a sectional view of an outdoor unit according to another embodiment of the present invention.

Referring to FIG. 6, the outdoor unit differs from the outdoor unit of the previous embodiment in terms of the arrangement of the auxiliary heat exchanger section 90. Hereinafter, the outdoor unit according to this embodiment will be described mainly in conjunction with the difference thereof from the outdoor unit of the previous embodiment.

The auxiliary heat exchanger section 90 is arranged outside the suction portion 311 and, as such, may heat outdoor air to be introduced into the suction portion 311. The auxiliary heat exchanger section 90 is installed at the housing 310 such that the auxiliary heat exchanger section 90 closes at least a part of the suction portion 311.

The air conditioner having the above-described configuration according to the present invention has at least the following effects.

It may be possible to continuously perform a heating operation for an indoor space without requiring a defrosting operation of the outdoor heat exchanger.

It may be unnecessary to periodically perform a defrosting operation and to stop a heating operation and, as such, heating efficiency of the overall system is improved.

Degradation of heating operation efficiency does not occur when a part of plural heat exchanger sections perform a frosting prevention operation, and another part of the plural heat exchanger sections perform a heating operation.

The flow of refrigerant is variable between a cooling mode and a heating mode.

Heat exchange between refrigerant and air is reduced in the heating mode while being increased in the cooling mode and, as such, the efficiency of the air conditioner is maximized.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. In addition, such modifications, additions and substitutions should not be separately determined based on the technical idea or prospect of the present invention.

What is claimed is:

1. An air conditioner comprising:

a compressor to compress a refrigerant;

a hot gas line to receive a first portion of the refrigerant compressed in the compressor;

an indoor heat exchanger to allow the refrigerant compressed in the compressor to exchange heat with an indoor air while passing through the indoor heat exchanger;

an outdoor heat exchanger to operate as a condenser in a cooling mode and operate as an evaporator in a heating mode, the outdoor heat exchanger allowing refrigerant to exchange heat with an outdoor air while passing through the outdoor heat exchanger; and a 4-way valve to receive a second portion of the refrigerant compressed in the compressor, and to guide the compressed refrigerant from the compressor to the outdoor heat exchanger in the cooling mode and from the compressor to the indoor heat exchanger in the heating mode, wherein the outdoor heat exchanger comprises a main heat exchanger section to operate as the condenser in the cooling mode and operate as the evaporator in the heating mode, an auxiliary heat exchanger to receive the refrigerant from the hot gas line in a frosting prevention mode, and a hot gas relief valve disposed at the hot gas line to adjust a flow of refrigerant, wherein the main heat exchanger section exchanges heat with the outdoor air, a portion of the outdoor air having exchanged heat with the auxiliary heat exchanger section while another portion of the outdoor air passes around the auxiliary heat exchanger section wherein the hot gas line is connected to the auxiliary heat exchanger section, wherein the hot gas line is branched between the 4-way valve and the compressor, and wherein the hot gas line is connected to the auxiliary distribution line.

2. The air conditioner of claim 1, wherein the auxiliary heat exchanger section operates as a condenser in the cooling mode, operates as an evaporator in the heating mode, and operates as a condenser in the frosting prevention mode.

3. The air conditioner of claim 2, wherein, in the frosting prevention mode, the refrigerant emerging from the auxiliary heat exchanger section flows to the main heat exchanger section and evaporates in the main heat exchanger section.

4. The air conditioner of claim 1, further comprising:

an outdoor expansion device to expand the refrigerant having exchanged heat in the indoor heat exchanger;

a main distribution line to direct refrigerant condensed in the indoor heat exchanger to the main heat exchanger section in the heating mode; and an auxiliary distribution line to direct the refrigerant condensed in the indoor heat exchanger to the auxiliary heat exchanger section in the heating mode, wherein the outdoor expansion device comprises:

a main expansion valve disposed at the main distribution line to adjust an opening degree of the main distribution line, and an auxiliary expansion valve disposed at the auxiliary distribution line to adjust an opening degree of the auxiliary distribution line.

5. The air conditioner of claim 4, further comprising:

an auxiliary connecting line to direct the refrigerant emerging from the auxiliary heat exchanger section to the main heat exchanger section in the frosting prevention mode.

6. The air conditioner according to claim 4, further comprising:

a main header pipe to direct the refrigerant emerging from the main heat exchanger section to the compressor in the heating mode;

an auxiliary header pipe connected to the main header pipe to direct the refrigerant emerging from the auxiliary heat exchanger section to the compressor in the heating mode; and a header relief valve disposed at the auxiliary header pipe to selectively allow flow of refrigerant through the auxiliary header pipe.

7. The air conditioner of claim 1, further comprising:

a housing comprising a suction portion to suction the outdoor air, and a discharge portion to discharge the suctioned air, the housing forming an air channel to guide the suctioned outdoor air to pass therethrough, wherein the main heat exchanger section is disposed in the air channel of the housing.

8. The air conditioner of claim 7, wherein the auxiliary heat exchanger section is disposed between the main heat exchanger section and the suction portion.

9. The air conditioner of claim 7, wherein the auxiliary heat exchanger section closes at least a part of the suction portion.

10. The air conditioner of claim 7, further comprising:

a fan to generate a flow of air in a direction from the suction portion toward the discharge portion.

11. The air conditioner of claim 7, wherein the main heat exchanger section overlaps with the auxiliary heat exchanger section.

12. An air conditioner comprising:

a compressor to compress a refrigerant;

a hot gas line to receive a first portion of the refrigerant compressed in the compressor;

an indoor heat exchanger to allow the refrigerant compressed in the compressor to exchange heat with an indoor air while passing through the indoor heat exchanger;

an outdoor heat exchanger to operate as a condenser in a cooling mode while functioning as an evaporator in a heating mode, the outdoor heat exchanger allowing refrigerant to exchange heat with outdoor air while passing through the outdoor heat exchanger;

a 4-way valve to receive a second portion of the refrigerant compressed in the compressor, and to guide the compressed refrigerant from the compressor to the outdoor heat exchanger in the cooling mode and to the indoor heat exchanger in the heating mode;

a hot gas relief valve disposed at the hot gas line to adjust a flow of refrigerant;

a dew point temperature sensor for measuring a dew point temperature of outdoor air;

an auxiliary heat exchanger section temperature sensor for measuring a temperature of air having exchanged heat with an auxiliary heat exchanger section, the measuring being indicative of the temperature of an auxiliary heat exchanger section;

a controller for controlling the hot gas relief valve, based on the dew point temperature measured by the dew point temperature sensor and the temperature of the auxiliary heat exchanger section measured by the auxiliary heat exchanger section temperature sensor, and a hot gas relief valve disposed at the hot gas line to adjust a flow of refrigerant, wherein the outdoor heat exchanger comprises a main heat exchanger section to operate as the condenser in the cooling mode and to operate as the evaporator in the heating mode, and the auxiliary heat exchanger to receive the refrigerant emerging from the hot gas line in a frosting prevention mode, wherein the hot gas line is connected to the auxiliary heat exchanger section, wherein the hot gas line is connected to the auxiliary heat exchanger section, wherein the hot gas line is branched between the 4-way valve and the compressor, and wherein the hot gas line is connected to the auxiliary distribution line.

13. The air conditioner of claim 12, wherein the controller controls the temperature of the auxiliary heat exchanger section to be higher than the dew point temperature in the heating mode.

14. The air conditioner of claim 12, wherein:

the controller closes the hot gas relief valve in the heating mode when the temperature of the auxiliary heat exchanger section is higher than the dew point temperature; and the controller opens the hot gas relief valve in the heating mode when the temperature of the auxiliary heat exchanger section is less than or equal to the dew point temperature.

15. The air conditioner of claim 14, further comprising:

an outdoor expansion device to expand the refrigerant having exchanged heat in the indoor heat exchanger;

a main distribution line to guide the refrigerant condensed in the indoor heat exchanger to the main heat exchanger section in the heating mode; and an auxiliary distribution line to guide the refrigerant condensed in the indoor heat exchanger to the auxiliary heat exchanger section in the heating mode, wherein the outdoor expansion device comprises:

a main expansion valve disposed at the main distribution line to adjust an opening degree of the main distribution line, and an auxiliary expansion valve disposed at the auxiliary distribution line to adjust an opening degree of the auxiliary distribution line, wherein the controller controls the auxiliary expansion valve to expand refrigerant in the heating mode when the temperature of the auxiliary heat exchanger section is higher than the dew point temperature, wherein the controller closes the auxiliary expansion valve in the heating mode when the temperature of the auxiliary heat exchanger section is less than or equal to the dew point temperature.

16. The air conditioner of claim 15, further comprising:

an auxiliary connecting line to guide the refrigerant from the auxiliary heat exchanger section to the main heat exchanger section in the frosting prevention mode; and an auxiliary relief valve disposed at the auxiliary connecting line to selectively allow a flow of refrigerant.

17. The air conditioner of claim 16, wherein:

the controller closes the auxiliary relief valve in the heating mode when the temperature of the auxiliary heat exchanger section is higher than the dew point temperature; and the controller opens the auxiliary relief valve in the heating mode when the temperature of the auxiliary heat exchanger section is less than or equal to the dew point temperature.

* * * * *